United States Patent [19]

Kilar

[11] 4,190,754

[45] Feb. 26, 1980

[54] SLIDE SWITCH ACTUATING APPARATUS

[75] Inventor: Joseph H. Kilar, Rolling Meadows, Ill.

[73] Assignee: Motorola, Inc., Schaumburg, Ill.

[21] Appl. No.: 962,271

[22] Filed: Nov. 20, 1978

[51] Int. Cl.[2] ..... H01H 3/02

[52] U.S. Cl. ..... 200/329; 74/527; 200/17 R

[58] Field of Search ..... 200/17, 18, 16 C, 16 D, 200/16 R, 60, 329, 330, 331, 332, 333, 338, 339; 74/527, 543; 16/110 R, 114 R, 116 R

[56] References Cited

U.S. PATENT DOCUMENTS

| | | | |
|---|---|---|---|
| 2,321,180 | 6/1943 | Bradbury | 200/60 |
| 2,966,560 | 12/1960 | Gluck | 200/16 C |
| 3,217,112 | 11/1965 | Campbell et al. | 200/339 X |
| 3,242,298 | 3/1966 | Miller | 200/338 |
| 3,668,938 | 6/1972 | Dimitry | 200/339 X |
| 3,674,953 | 7/1972 | Brevick | 200/16 D X |
| 3,946,186 | 3/1976 | Howie, Jr. | 200/330 X |
| 3,993,881 | 11/1976 | Marsilio | 200/339 X |
| 3,997,968 | 12/1976 | Czerner et al. | 200/330 X |

*Primary Examiner*—Stephen Marcus

*Attorney, Agent, or Firm*—James W. Gillman; Melvin A. Klein

[57] ABSTRACT

A slide switch actuating apparatus for operating a slide switch located inside a housing from the exterior thereof. A flexible retaining member engages the slide switch to be actuated on the interior of the housing. The housing is formed with a slot through which flexible hook members are received into a socket portion of a button member located exterior to the housing in a snap-fit fashion. A plurality of bosses with inclined surfaces are positioned on the interior of the housing adjacent to the slot opening to contact end portions of the flexible retaining member to effect a detent action upon sliding actuation of the switch located inside the housing.

3 Claims, 2 Drawing Figures

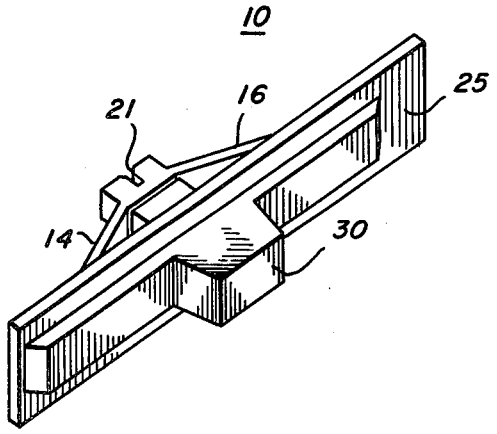
FIG. 1
FIG. 2
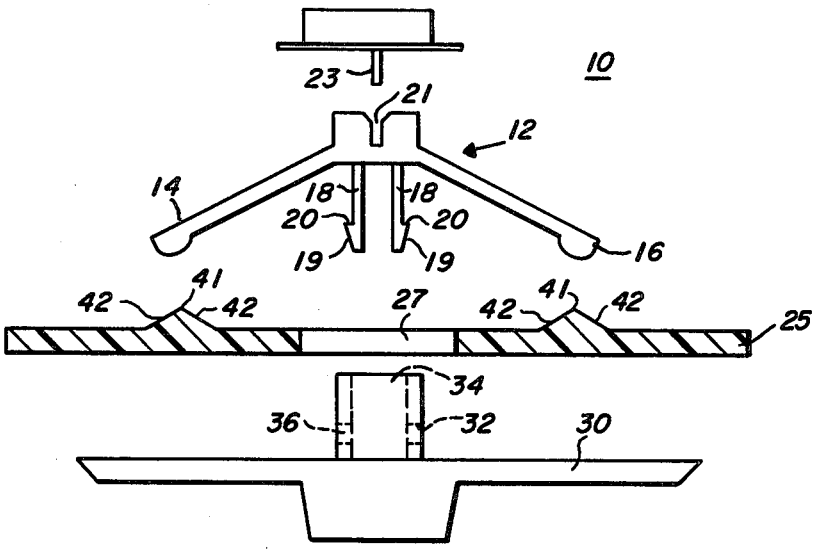

SLIDE SWITCH ACTUATING APPARATUS

BACKGROUND OF THE INVENTION

This invention relates to an improved slide switch actuating apparatus to operate a switch located on the interior of a housing from a remote location outside the housing.

In the past, in the assembly of electrical apparatus, such as, radios and the like having switch mechanisms located in the interior of a housing it has been necessary to provide for a time consuming assembly operation for the purpose of attaching actuating members for operating the switches located therein. Examples of such electrical switch actuation devices are described for example in U.S. Pat. Nos. 2,415,298 and 2,813,938. A further approach has been to fabricate expensive molded assemblies which are also quite complex as indicated, for example in U.S. Pat. No. 3,833,784. As a result, difficulties have been encountered during the assembly operation as well as expense for both hardware and time consuming operations.

SUMMARY OF THE INVENTION

In accordance with the instant invention, an improved actuation apparatus is provided enabling a slide switch located in the interior of the housing to be operated from the exterior thereof in the absence of the complicated and expensive assemblies used heretofore. The present invention, generally speaking, is accomplished by providing a relatively simple snap-bit actuating apparatus with a minimum of parts.

It is therefore a primary object of the present invention to improve the actuation and assembly of switching apparatus.

It is a further object of the present invention to provide apparatus to actuate a slide switch located on the interior of a housing from a remote location exterior to the housing.

It is a further object of the present invention to operate a slide switch of a radio or the like which is inaccessible from a remote location.

It is still a further object of the present invention to control the actuation of the slide switch located behind the front escutcheon from the exterior thereof.

It is still a further object of the present invention to actuate a slide switch located within the housing of electrical apparatus in a more simplified matter than used heretofore.

It is still a further object of the present invention to provide a simplified construction for a slide switch actuating apparatus.

BRIEF DESCRIPTION OF THE DRAWINGS

These and other objects and advantages of the present invention will become more apparent from the following specification which will be read in conjunction with the accompanying drawings FIG. 1 is an isometric view of the improved slide switch actuating apparatus according to the present invention; and FIG. 2 is an exploded view of the actuating apparatus illustrating details thereof.

DETAILED DESCRIPTION OF THE INVENTION

FIG. 1 shows the slide switch actuating apparatus generally designated 10 according to the invention. As best shown in FIG. 2, actuating apparatus 10 includes a retaining member generally designated 12 made of flexible material and having arm members 14 and 16 and a plurality of hook members 18 which have tapered end portions 19 and hook portions 20. The retaining member 12 has a notch 21 formed therein for receiving a bracket 23 or the like connected to the switch device (not shown) to be actuated which is located on the interior of escutcheon or housing 25.

On the exterior of escutcheon 25 is a button member 30 positioned in overlying relationship with retaining member 12. Escutcheon 25 is formed with a slot 27 through which a socket portion 32 of button member 30 can be inserted. Socket portion 32 is formed with a hollowed section 34 therein for the purpose of receiving hook member 18. It will be noted that a plurality of holes 36 are formed in socket portions 32 for engaging with the hook portions 20 which flex inwardly and then outwardly to produce a snap-fit. By this structure a simple yet reliable engagement between members 12 and 30 is obtained.

It will be observed that escutcheon 25 is formed with a a plurality of bosses 41 with inclined sides 42 on the interior surface thereof. By this structure, a detent action is obtained upon sliding contact between the ends of arm members 14 and 16 and inclined surfaces 42 in the actuation of the switch device.

It will now be appreciated that by the above-described invention, a new and improved switch actuating assembly is achieved. Moreover, the time of assembly is greatly minimized and by virtue of the simplified construction thereof the cost greatly reduced.

While the invention is described with respect to a preferred embodiment thereof, it should be understood that modifications may be made without departing from the spirit of the invention which should only be interpreted in light of its claims.

I claim:

1. An improved slide switch actuating apparatus comprising:

a housing;

a slide switch device to be actuated located interior to said housing;

an elongated flexible retaining member engaging said slide switch device;

said retaining member having flexible hooking means extending towards the exterior of said housing;

said housing having a slot formed therein; and a button member positioned exterior to said housing in overlying relation with said slot and having a socket portion to receive said hooking means in a snap fit;

wherein said housing includes at least one boss portion formed by inclined surfaces positioned on the interior thereof adjacent to said slot to contact said retaining member upon sliding movement thereof;

wherein said retaining member includes a plurality of flexible arm members each said arm member contacting said inclined surfaces during relative movement therebetween to effect a detent action in the operation thereof.

2. Apparatus according to claim 1 wherein said socket portion has at least one aperture formed therein to lockingly engage with said hooking means.

3. Apparatus according to claim 2 wherein said hooking means includes a plurality of hook members.

* * * * *